US007992260B1

(12) United States Patent
Juilly

(10) Patent No.: US 7,992,260 B1
(45) **Date of Patent: *Aug. 9, 2011**

(54) BINDER CLIP WITH LABEL HOLDER

(76) Inventor: Brett A. Juilly, Studio City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/731,727

(22) Filed: Mar. 25, 2010

Related U.S. Application Data

(63) Continuation of application No. 11/236,898, filed on Sep. 28, 2005, now Pat. No. 7,730,593.

(60) Provisional application No. 60/613,924, filed on Sep. 28, 2004.

(51) Int. Cl.

| | |
|---|---|
| ***B42F 1/02*** | (2006.01) |
| ***B42F 1/04*** | (2006.01) |
| ***G09F 3/16*** | (2006.01) |
| ***G09F 7/00*** | (2006.01) |

(52) U.S. Cl. ..... 24/67.5; 24/67.3; 24/67 R; 40/658; 40/666

(58) Field of Classification Search ..... None
See application file for complete search history.

(56) References Cited

U.S. PATENT DOCUMENTS

| | | | | |
|---|---|---|---|---|
| 1,133,388 | A | 3/1915 | Merrill | |
| 1,139,627 | A | 5/1915 | Baltzley | |
| 1,476,420 | A | 12/1923 | Roming | |
| 1,493,072 | A | 5/1924 | Fricker | |
| 3,225,469 | A | 12/1965 | Chase | |
| 3,286,381 | A | 11/1966 | Wooge | |
| 3,343,289 | A | 9/1967 | Chamberlin | |
| 3,370,365 | A | 2/1968 | Vosbikian | |
| 3,648,334 | A | 3/1972 | Swalm | |
| 4,211,805 | A | 7/1980 | Chamberlin | |
| 4,286,358 | A | 9/1981 | Levin | |
| 4,389,755 | A | 6/1983 | Villa-Real | |
| 4,532,680 | A | 8/1985 | Hashimoto | |
| 4,761,862 | A | 8/1988 | Hiromori | |
| 4,951,408 | A | 8/1990 | Banks | |
| 5,170,535 | A | 12/1992 | Strong | |
| 5,398,384 | A | 3/1995 | Rinard | |
| 5,533,236 | A | 7/1996 | Tseng | |
| 5,870,802 | A | 2/1999 | Goldman | |
| 5,937,485 | A | 8/1999 | Dittmer | |
| 5,950,283 | A | 9/1999 | Sato | |
| 6,374,463 | B1 | 4/2002 | Kaufman | |
| 2001/0032376 | A1 * | 10/2001 | Payne | 24/67.5 |
| 2003/0061688 | A1 | 4/2003 | Rodriguez et al. | |
| 2005/0060923 | A1 | 3/2005 | Ardern, II | |
| 2005/0179247 | A1 | 8/2005 | Hough et al. | |

OTHER PUBLICATIONS

Staples® Bind-it Flag Clips™, Staples Online Catalog. http://www.staples.com/webapp/wcs/stores/servlet/StaplesProductDisplay?storeId=10001&catalogId=10051&langId=-1&productId=-103894&cmArea=SEARCH, Sep. 19, 2005.

* cited by examiner

*Primary Examiner* — Robert J Sandy
(74) *Attorney, Agent, or Firm* — Curatolo Sidoti Co., LPA; Salvatore A. Sidoti; Joseph G. Curatolo

(57) ABSTRACT

An improved binder clip is provided. The binder clip includes a clamping means, opposed gripping means attached to the clamping means, and a label holder that is attached to, or that is integral with, the clamping means. An identifying label is inserted into the label holder for easy identification of the material that is bound by the binder clip.

24 Claims, 2 Drawing Sheets

BINDER CLIP WITH LABEL HOLDER

CROSS REFERENCE TO RELATED APPLICATIONS

The present application is a continuation of U.S. Ser. No. 11/236,898, filed Sep. 28, 2005, now U.S. Pat. No. 7,730,593, which claims the benefit of the filing date under 35 USC §119 (e) of United States Provisional Application for Patent Ser. No. 60/613,924 filed Sep. 28, 2004, both of which are incorporated herein by reference in their entireties.

BACKGROUND

The present invention relates to a binder clip for binding together a plurality of loose items, such as a plurality of sheets of paper. The present invention more particularly relates to a binder clip for binding together loose sheets of paper, which includes a holder that can retain and display an identifying label.

In an office or educational setting, binder clips are frequently used to bind together loose sheets of paper. The binder clips generally include a clamping or pinching means and opposing gripping means that are attached to the pinching means. The gripping means rest on opposing surfaces of the pinching means. In operation, the pinching means is opened by squeezing together the ends of the gripping means. A stack of loose papers is inserted into the opened pinching means, and the gripping means are relaxed, thereby binding the stack of loose papers together.

Binder clips are effective at holding together loose sheets of papers. Prior art binder clips are also provided in a variety of colors and sizes to aid in the classifying and organizing of bound materials. While certain prior art binder clips provide means by which a person can identify the subject matter of the papers bound together by a particular binder clip, such means include dangerous metal projections which pose a risk of injury for the user and damage to office furniture, or do not protect the label from damage.

Therefore, a need still exists in the office supply art for an improved binder clip that incorporates a label so that a stack of bound papers can be quickly and easily identified, wherein the label holder can accommodate various sized identifying labels, wherein the label holder protects the label from damage, and wherein the label holder does not pose a risk of injury to the user or a risk of damage to office furniture.

SUMMARY

A binder clip is provided, said binder clip comprising clamping means, gripping means attached to said clamping means, and a label holder attached to said clamping means. According to certain illustrative embodiments, the binder clip comprises clamping means comprising a first side member, a second side member, and a connecting portion; gripping handles attached to said clamping means; and a label holder having a cavity for holding an identifying label, said label holder attached to said clamping means in a parallel plane relative to said connecting portion of said clamping means.

According to other illustrative embodiments, said binder clip comprises clamping means, gripping means attached to said clamping means, and a label holder integral with said clamping means. The binder clip comprises clamping means comprising a first side member, a second side member, and a connecting portion; gripping handles attached to said clamping means; and a label holder having a cavity for holding an identifying label, said label holder integral with said clamping means in a parallel plane relative to said connecting portion of said clamping means.

According to further illustrative embodiments, said binder clip comprises said clamping means, gripping means attached to said clamping means, a frame attached to, or integral with, said clamping means, and a label holder engaged with said frame. The binder clip comprises clamping means comprising a first side member, a second side member, and a connecting portion; gripping handles attached to said clamping means; and a label holder having a cavity for holding an identifying label, said label holder associated with said frame in a parallel plane relative to said connecting portion of said clamping means.

DETAILED DESCRIPTION

Figure 1:
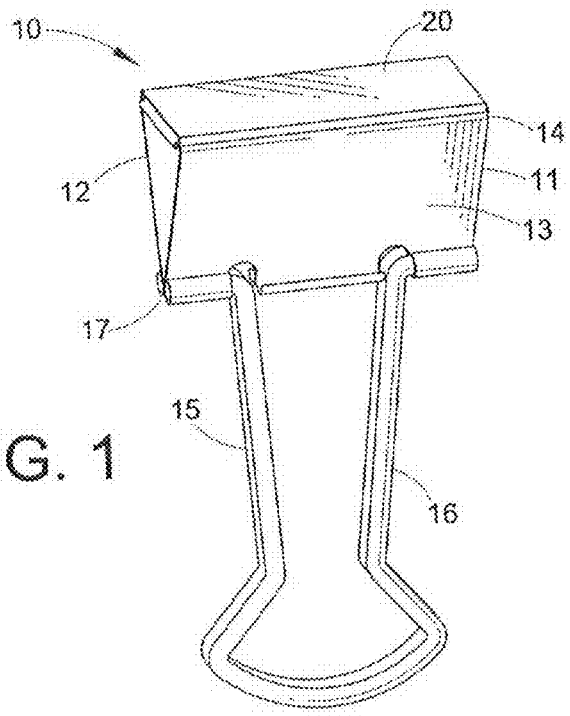
FIG. 1 is a front perspective view of one illustrative embodiment of the binder clip with label holder.

An improved binder clip for binding together a plurality of loose sheets of paper is provided. The binder clip includes a clamping means to clamp together a plurality of sheets of paper or the like. The binder clip also includes a pair of opposed gripping means, such as gripping handles, that are pivotably attached to the clamping means. The gripping means may also be removably attached to the clamping means of the binder clip. The gripping means are provided for permitting the user to grip the binder clip and for squeezing open the clamping means of the binder clip to a position to accept loose sheets of paper or the like. Channels located on the outer surfaces of opposing sides of terminal ends of the clamping means are used to pivotably or rotatably retain the gripping means to the clamping means. A label holder is attached to, or integral with, the clamping means to permit a label to be associated with the binder clip. The label holder defines a cavity or channel that is adapted to receive and hold an identifying label. The use of the label holder and an identifying label permit quick and easy identification of the subject matter of the papers that are bound together by the binder clip.

According to certain embodiments, the binder clip comprises a clamping means that includes a first side, a second side, and a portion connecting the first and second sides. Gripping means are attached to the clamping means and a label holder is attached to the clamping means for holding an identifying label in a plane that is parallel to the connecting portion of the clamping means.

In accordance with another illustrative embodiment, the binder clip includes a clamping means for clamping together a plurality of sheets of paper or the like, opposed gripping means attached to the clamping means, and a label holder that is integral with the clamping means. The clamping means includes a first side, a second side, and a portion connecting the first and second sides. The integral label holder retains an identifying label in a plane that is parallel to the connecting portion of the clamping means.

In accordance with a further illustrative embodiment, the binder clip includes a clamping means for clamping together a plurality of sheets of paper or the like, a pair of opposed gripping means that are attached to the clamping means, a frame that is attached to the clamping means, and a label holder that is engaged with the frame. The clamping means includes a first side, a second side, and a portion connecting the first and second sides. According to this illustrative embodiment, the frame includes a window region to reveal the contents of the label that is inserted into the frame. The label holder is secured to the clamping means by the frame. The frame and label holder retain an identifying label in a plane that is parallel to the connecting portion of the clamping means.

In accordance with yet a further illustrative embodiment, the binder clip includes a clamping means for clamping together a plurality of sheets of paper or the like, a pair of opposed gripping means that are attached to the clamping means, a frame that is integral with the clamping means, and a label holder that is engaged with the frame. The clamping means includes a first side, a second side, and a portion connecting the first and second sides. According to this embodiment, the frame includes a window region to reveal the label that is inserted into the frame. The label holder is secured to the clamping means by the frame. The frame and label holder retain an identifying label in a plane that is parallel to the connecting portion of the clamping means.

The clamping means of the binder clip may be manufactured from any flexible, but resilient material. That is, the material from which the clamping means is manufactured has enough flexibility to permit the opening and closing of the binder clip by the squeezing of the opposed gripping means without causing permanent deformation of the clamping means structure. Suitable materials from which the clamping means of the binder clip may be manufactured include, but are not limited to, metals, metal alloys, and plastic materials. According to certain embodiments, the clamping means of the binder clip is manufactured from a metal alloy, such as a steel alloy. However, other metals and metal alloys that result in a flexible, but resilient clamping means may be used, and one having ordinary skill in the art can easily ascertain the identity of such materials without conducting undue experimentation.

The binder clip includes a label holding means that is either attached to the clamping means or that is integral with the clamping means. The label holder may be transparent and provides a cavity or channel for holding and displaying a label that is inserted into the label holder. The cavity for holding the label may be an elongated channel which receives and retains an identifying label. The label holder is associated with the clamping means in a manner which permits the label holder to hold an identifying label in a plane that is parallel to the plane of the connecting portion of the clamping means of the binder clip.

According to certain embodiments, the label holder is manufactured from a flexible, transparent, plastic material. Without limitation, suitable plastic materials that may be used to manufacture the transparent label holder include polyamides, such as nylons, polyesters, polyolefins, and polyvinyls. It should be understood that any plastic material that can form a transparent material and that can be manipulated to form a cavity or channel can be used to manufacture the label holder of the binder clip, and that such plastic materials can be easily ascertained by one having ordinary skill in the art without conducting undue experimentation.

Suitable polyolefins from which the label holder may be manufactured include, without limitation, polyethylenes, polypropylenes, and mixtures of polyethylenes and polypropylenes. High density polyethylene (HDPE) may be utilized alone or in combination with other polyolefins to manufacture the label holder of the binder clip. Suitable polyvinyls include, without limitation, polyvinyl acetate and polyvinyl chloride. Other polymers including an acetate group can be used to manufacture the label holder. A suitable polyester that can be utilized to manufacture the label holder of the binder clip is commercially available under the trademark MYLAR™.

According to certain embodiments, the label holder is attached to the clamping means of the binder clip. The label holder may be attached to the clamping means of the binder clip by any means of attachment such as, without limitation, adhesives and mechanical fasteners. According to alternative illustrative embodiments, the label holder may be attached to the clamping means of the binder clip by means of integral projections or tabs which extend from the label holder. According to certain embodiments, the integral tabs of the label holder may be folded under the bottom surface of the connecting portion of the clamping means to secure the label holder to the clamping means. According to further embodiments, the integral projections of the label holder may be inserted into recesses, grooves, slots, or openings provided on the clamping means of the binder clip to secure the label holder to the clamping means.

According to another embodiment, the binder clip includes clamping means, opposed gripping means that are attached to the clamping means, a label holder that is attached to or that is integral with the clamping means, and an identifying label that is inserted into the label holder. The label holder is attached to the clamping means of the binder clip in a manner such that the identifying label that is inserted into the label holder is positioned in a plane that is parallel to the connecting portion of the clamping means of the binder clip.

The binder clip incorporating a label holder will now be described in greater detail with reference to the FIGURES. It should be noted that the binder clip is not intended to be limited to the illustrative embodiments shown in the FIGURES, but should be construed in breadth and scope with the attached claims.

FIG. 1 shows binder clip 10. Binder clip 10 includes clamping means 11. Clamping means 11 includes first side member 12, second side member 13, and connecting portion 14 extending between first side member 12 and second side member 13. The connecting portion 14 of the clamping means 11 may be referred to as the spine of the clamping portion 11 of the binder clip 10. Together, first side 12, second side 13, and connecting portion 14 provide the clamping means 11 of the binder clip 10 with a substantially triangularly shaped cross section. According to preferred embodiments, the clamping means 11 of the binder clip 10 comprises a one piece construction including first side member 12, second side member 13, and connecting portion 14.

Still referring to FIG. 1, attached to clamping means 11 of binder clip 10 are a pair of gripping handles 15, 16. Gripping handle 15 is pivotably attached to first side 12 near the pinching end 17 of clamping means 11 of binder clip 10. Gripping handle 16 is pivotably attached to second side 13 near the pinching end 17 of clamping means 11 of binder clip 10. Opposing gripping handles 15, 16 may be removably attached to first side 12 and second side 13, respectively, by inserting terminal bend portions into channels located near pinching end 17 of the clamping means 11. Label holder 20 is secured to connecting portion 14 of clamping means 11 of binder clip 10. Integral tab portion 21 is shown folded under connecting portion 14.

Figure 2:
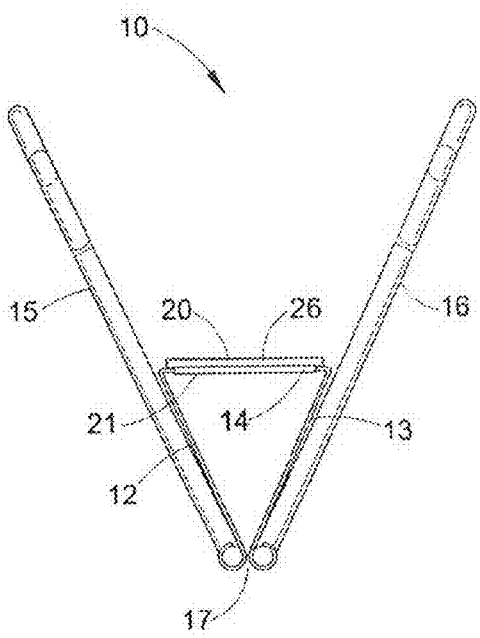
FIG. 2 is a side view of the illustrative embodiment of the binder clip with label holder shown in FIG. 1.

FIG. 2 shows a side view of the illustrative embodiment of FIG. 1. According to the illustrative embodiment shown in FIG. 2, binder clip 10 includes clamping means 11. Clamping means 11 includes side 12, side 13, and connecting portion 14 extending between and connecting side 12 and side 13. A label holder 20 for receiving and retaining an identifying label is secured to the clamping means 11 of the binder clip 10. The label holder 20 is secured to the clamping means 11 by folding integral tab portion 21, under the bottom surface of the connecting portion 14 of the clamping means 11. Thus, the label holder 20 is disposed above the top surface of the connecting portion 14 of the clamping means 11 of the binder clip 10.

Figure 3:
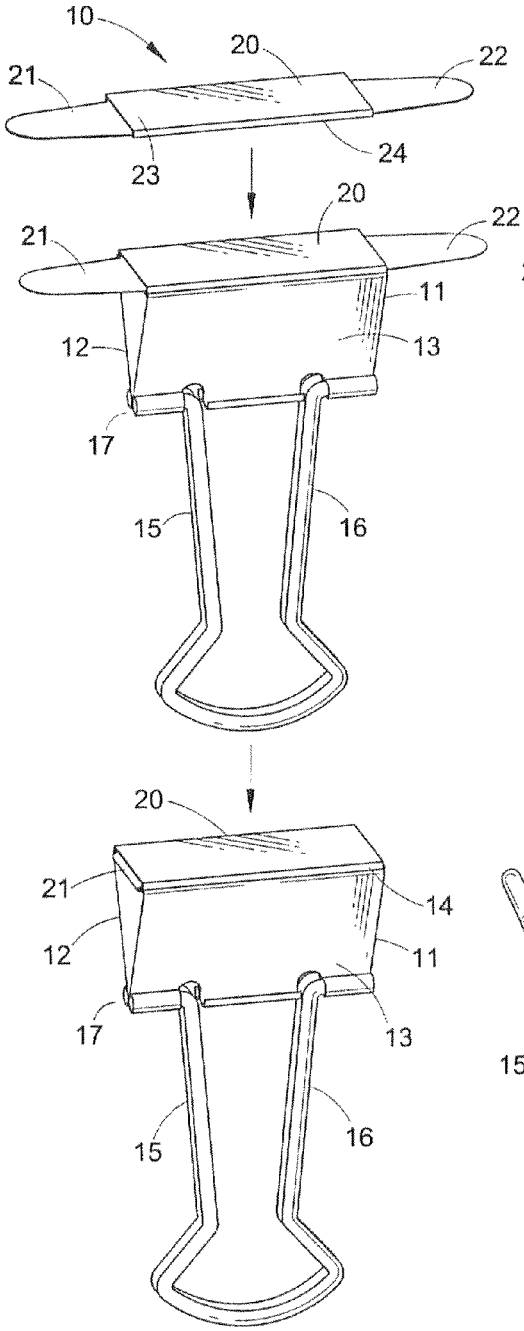
FIG. 3 is a side view of another illustrative embodiment of the binder clip with label holder.

FIG. 3 shows a process flow for preparing the binder clip 10 having a label holder 20. According to FIG. 3, label holder 20 is attached to clamping means 11 of binder clip 10. Label holder 20 appears as a substantially flattened sleeve- or tube-like structure. According to FIG. 3, label holder 20 includes integral tab members 21, 22 that are located at opposite ends of label holder 20, and a label holding portion 23. According to FIG. 3, the label holder 20 is attached to the connecting portion 14 of the clamping means 11 by positioning the bottom surface 24 of the label holder 20 adjacent to the top surface of the clamping means 11 of the binder clip 10. Once the label holder 20 is positioned adjacent to the top surface of the connecting portion 14 of the clamping means 11, then the integral tabs 21, 22 are folded under the bottom surface of the connecting portion 14 of the clamping means 11. Thus, according to FIGS. 2 and 3, the label holder is positioned on the spine 14 of the clamping means 11 of the binder clip 10 in such a manner to be able to hold an identifying label in a plane that is parallel to the plane of the spine 14 of the clamping means 11.

Figure 4:
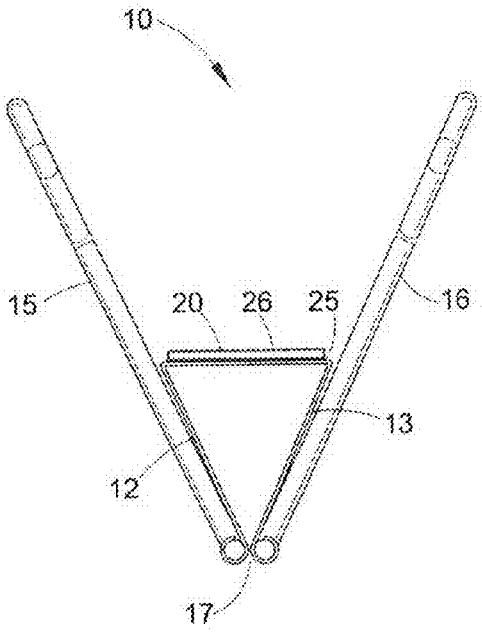
FIG. 4 is an exploded front view of the illustrative embodiment of the binder clip with label holder shown in FIGS. 1 and 2.

FIG. 4 shows another illustrative embodiment of the binder clip 10. According to FIG. 4, binder clip 10 includes clamping means 11. Clamping means 11 includes first side 12, second side 13, and connecting portion 14 extending between first side 12 and second side 13. A label holder 20 is secured to the top surface of connecting portion (i.e. —the spine) 14 of clamping means 11 of the binder clip 10. The label holder may be attached or is otherwise secured to the top surface of connecting portion 14 of the clamping means 11 by means of an adhesive 25 that is disposed between the bottom surface 24 of the label holder 20 and the top surface of the connecting portion 14 of the clamping means 11. Thus, the label holder 20 is secured to the top edge or spine of the clamping means 11 of the binder clip 10. It should be noted that the amount of adhesive 25 to be used is an amount sufficient to secure the label holder 20 to the spine 14 of the clamping means 11. Accordingly, it is contemplated that the adhesive may be applied in any discontinuous or continuous pattern.

Figure 5:
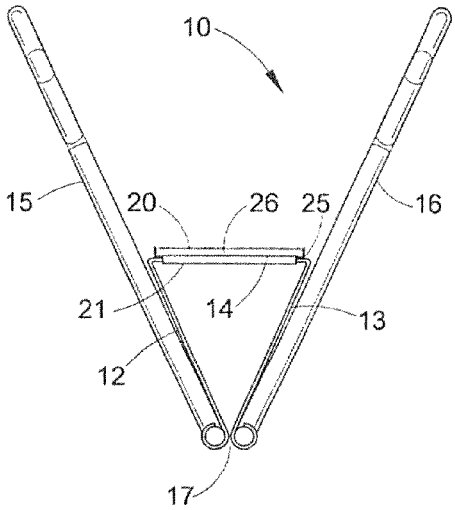
FIG. 5 is a side view of a further illustrative embodiment of the binder clip with label holder.

FIG. 5 shows another illustrative embodiment of the binder clip 10. According to the illustrative embodiment shown in FIG. 5, the label holder 20 may be attached to the connecting portion 14 of the clamping means 11 by placing an adhesive material 25 between the bottom surface 24 of the label holder 20 and the top surface of the connecting portion 14 of the clamping means 11. Once the label holder 20 having opening 26 is in place adjacent the top surface of the connecting portion 14 of the clamping means 11, then the integral tabs 21, 22 of the label holder 20 are folded under the bottom surface connecting portion 14 of the clamping means 11 of the binder clip 10. The dual means of the adhesive 25 and opposing integral tabs 21, 22 serve to secure the label holder in place on the top surface of connecting portion 14 of the clamping means 11.

With respect to all the illustrative embodiments of the binder clip with label holder, the label holder 20 appears as a somewhat flattened sleeve- or tube-like structure. This flattened sleeve- or tube-like structure is generally coextensive in length with the connecting portion 14 of the clamping means 11 of binder clip 10, although it is within the scope of the invention to provide the label holder with any length. The label holder 20 provides one or more openings 26 or slots for the insertion of an identifying label, and a cavity for retaining the identifying label within the label holder 20. According to certain embodiments, the cavity of label holder 20 may be provided as an elongated channel, passage, or the like having openings at opposite ends.

The label holder may comprise a transparent, plastic, flattened tube-like structure prepared by known plastic extrusion processes. Alternatively, the label holder 20 may be constructed from a relatively flat sheet of plastic material, which has been manipulated to create a flattened tube-like structure having one or more openings and a cavity sufficient to accept and securely hold a label within the label holder.

For alternative embodiments utilizing the manipulated plastic sheet, an adhesive tape may be adhered to a portion of the flat plastic sheet. The adhesive tape extends beyond opposite lateral side edges of the plastic sheet material. The remaining portion of the plastic sheet is manipulated by folding, for example, to create a flattened tube-like structure. The flattened tube-like label holder is positioned over the upper surface of the connecting portion 14 of the clamping means 11 of the binder clip 10. The label holder is moved into closer proximity to the upper surface of the connecting portion 14 and the adhesive tape extending beyond the lateral side edges of the plastic sheet are folded under and thereby are adhered to the bottom surface of the connecting portion 14 of the clamping means 11.

The use of label holder 20 having extending tabs at opposite ends facilitates the easy insertion of a label into the cavity of the label holder 20, which is located on the upper surface of connecting portion 14 of the clamping means 11. Because the integral tabs are folded under the bottom surface of the connecting portion 14 of the clamping means 11, there is no space between the bottom surface of the label holder 20 and the top surface of the connection portion 14 of the clamping means 11 of the binder clip 10 at the point where the label is to be inserted into the cavity or channel of the label holder 20. Accordingly, the use of the integral tabs substantially eliminates the possibility that an identifying label would be inserted into the space between the bottom surface 24 of the label holder 20 and the top surface of the connecting portion 14 of the clamping means 11, rather than being inserted into the cavity 26 of the label holder 20.

Figure 6:
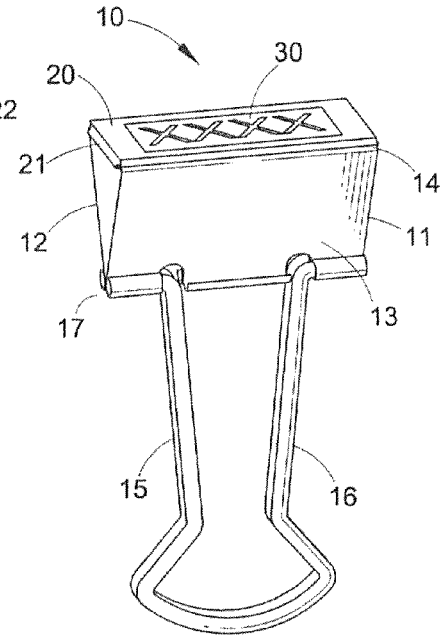
FIG. 6 is a front perspective view of the illustrative embodiment of the binder clip shown in FIGS. 1 and 2 with an identifying label inserted into the label holder.

Now turning to FIG. 6, the binder clip 10 includes clamping means 11. Clamping means 11 includes first side 12, second side 13, and connecting portion 14 between first side 12 and second side 13. Attached to clamping means 11 of binder clip 10 are a pair of opposed gripping means 15, 16. Gripping means 15 is attached to first side 12 near the pinching end 17 of clamping means 11 of binder clip 10. Gripping means 16 is attached to second side 13 near the pinching end 17 of clamping means 11 of binder clip 10. Label holder 20 is secured to the top surface of connecting portion 14 of the clamping means 11. According to FIG. 6, identifying label 30 is shown as inserted into label holder 20. Label 30 is a label made of paper or other similar material and which has a length and width that can be accommodated by the label holder 20.

Label 30 is shown with the generic text "XXXX" thereon. The label 30 is held securely within the cavity 23 of the label holder 20 by forces exerted against the label 30 by the label holder 20, and will not fall out during ordinary use of the binder clip. Nevertheless, the label 30 may be easily inserted into and removed from the label holder 20.

To utilize the binder clip, a label is inserted into the label holder 20. Once the label is secured by the label holder 20, the opposed pair of gripping handles 15, 16 are manually squeezed to spread apart sides 12, 13 of the clamping means 11 in order to open the binder clip. Edges of a plurality of loose sheets of paper or the like are inserted into the open binder clip 10 and the gripping handles 15, 16 are released, thereby closing the binder clip 10. The sides 12, 13 pinch the loose sheets of paper near pinching end 17.

Alternatively, the opposed pair of gripping handles 15, 16 of the binder clip 10 are manually squeezed to spread apart sides 12, 13 of the clamping means 11 in order to open the binder clip. Edges of a plurality of loose sheets of paper or the like are inserted into the open binder clip 10 and the gripping handles 15, 16 are released, thereby closing the binder clip 10. The sides 12, 13 pinch the loose sheets of paper near pinching end 17. Thereafter, an identifying label 30 may be inserted into the label holder 20. Furthermore, the label 30 may be removed from the label holder 20 and replaced after loose paper have already been bound by binder clip 10.

Thus, the binder clip with label holder provides a means by which a person can quickly and easily identify the content or subject matter of the papers bound together by a particular binder clip, as the label holder is associated with the binder clip in a manner such that an identifying label is held by the label holder in a plane that is parallel to the plane of the spine of the binder clip.

The label holder of the binder clip does not include any sharp protections, which would pose an injury hazard for the user, or which may damage the surfaces of office furniture.

As the identifying label is enclosed or surrounded by the label holder, except for the openings) provided for insertion and removal of the identifying label, the label is protected from damage from external environment.

With respect to all embodiments described herein, the elongated cavity of the label holder permits the label holder to securely hold and display a substantially flat or planar identifying label in a parallel plane, relative to the upper surface of the connecting portion 14 of the clamping means 11 of thr binder clip 10.

While the present invention has been described above in connection with illustrative embodiments, as shown in the various FIGURES, it is to be understood that other similar embodiments may be used or modifications and additions may be made to the described embodiments for performing the same function of the present invention without deviating therefrom. Further, all embodiments disclosed are not necessarily in the alternative, as various embodiments of the invention may be combined to provide the desired characteristics. Variations can be made by one having ordinary skill in the art without departing from the spirit and scope of the invention. Therefore, the present invention should not be limited to any single embodiment, but rather construed in breadth and scope in accordance with the recitation of the attached claims.

I claim:

1. A binder clip comprising:

clamping means comprising a first side member, a second side member, and a connecting portion;

gripping handles attached to said clamping means; and a label holder for surrounding and holding an identifying label in a parallel plane relative to said connecting portion, said label holder attached to said clamping means in a parallel plane relative to said connecting portion of said clamping means.

2. The binder clip of claim 1, wherein said clamping means comprises a substantially triangular cross sectional shape.

3. The binder clip of claim 1, wherein said clamping means is manufactured from a material selected from the group consisting of metals, metal alloys, and plastic materials.

4. The binder clip of claim 3, wherein said clamping means is manufactured from a metal alloy.

5. The binder clip of claim 4, wherein said metal alloy is a steel alloy.

6. The binder clip of claim 1, wherein said label holder is attached to said clamping means by an adhesive, by at least one mechanical fastener, or by a combination of an adhesive and at least one mechanical fastener.

7. The binder clip of claim 1, wherein said label holder is attached to said clamping means by integral tabs projecting from opposite ends of said label holder and that are folded under said connecting portion of said clamping means.

8. The binder clip of claim 1, wherein said label holder is manufactured from a transparent material.

9. The binder clip of claim 8, wherein said label holder is manufactured from a plastic material selected from the group consisting of polyamides, polyesters, polyolefins, and polyvinyls.

10. The binder clip of claim 1, wherein said label holder comprises an elongated channel.

11. The binder clip of claim 1, further comprising a label inserted into said label holder.

12. The binder clip of claim 1, further comprising a frame attached to, or integral with, said clamping means of said binder clip.

13. A binder clip comprising:

clamping means comprising a first side member, a second side member, and a connecting portion;

gripping handles attached to said clamping means; and a substantially flattened, tubular label holder having at least one opening and a cavity sufficient to accept and securely hold a label attached to said clamping means in a parallel plane relative to said connecting portion of said clamping means.

14. The binder clip of claim 13, wherein said clamping means comprises a substantially triangular cross sectional shape.

15. The binder clip of claim 13, wherein said clamping means is manufactured from a material selected from the group consisting of metals, metal alloys, and plastic materials.

16. The binder clip of claim 15, wherein said clamping means is manufactured from a metal alloy.

17. The binder clip of claim 16, wherein said metal alloy is a steel alloy.

18. The binder clip of claim 13, wherein said label holder is manufactured from a transparent plastic material.

19. The binder clip of claim 18, wherein said label holder is manufactured from a material selected from the group consisting of polyamides, polyesters, polyolefins, and polyvinyls.

20. The binder clip of claim 13, wherein said substantially flattened tubular label holder defines a cavity for holding an identifying label.

21. The binder clip of claim 13, wherein said label holder is attached to said clamping means by an adhesive, by at least one mechanical fastener, or by a combination of an adhesive and at least one mechanical fastener.

22. The binder clip of claim 13, wherein said label holder is attached to said clamping means by integral tabs projecting from opposite ends of said label holder and that are folded under said connecting portion of said clamping means.

23. The binder clip of claim 13, further comprising a label inserted into said label holder.

24. The binder clip of claim 13, further comprising a frame attached to, or integral with, said clamping means of said binder clip.

* * * * *